US010228170B2

(12) United States Patent
Voorhis et al.

(10) Patent No.: US 10,228,170 B2
(45) Date of Patent: Mar. 12, 2019

(54) REFRIGERANT DISTRIBUTOR OF MICRO-CHANNEL HEAT EXCHANGER

(71) Applicant: TRANE INTERNATIONAL INC., Piscataway, NJ (US)

(72) Inventors: Roger J. Voorhis, Clarksville, TN (US); Jun Wang, Clarksville, TN (US)

(73) Assignee: TRANE INTERNATIONAL INC., Davidson, NC (US)

( * ) Notice: Subject to any disclaimer, the term of this patent is extended or adjusted under 35 U.S.C. 154(b) by 48 days.

(21) Appl. No.: 14/654,796

(22) PCT Filed: Dec. 20, 2013

(86) PCT No.: PCT/US2013/077062
§ 371 (c)(1),
(2) Date: Jun. 22, 2015

(87) PCT Pub. No.: WO2014/100651
PCT Pub. Date: Jun. 26, 2014

(65) Prior Publication Data

US 2015/0345843 A1 Dec. 3, 2015

Related U.S. Application Data

(60) Provisional application No. 61/740,729, filed on Dec. 21, 2012.

(51) Int. Cl.
*F28F 9/02* (2006.01)
*F25B 41/04* (2006.01)
(Continued)

(52) U.S. Cl.
CPC ..... *F25B 41/043* (2013.01); *F28F 9/026* (2013.01); *F28F 9/0246* (2013.01);
(Continued)

(58) Field of Classification Search
CPC ..... F28F 27/02; F28F 9/027; F28F 9/0273; F28F 9/0275; F28F 2250/06; F25B 39/028; F25B 2341/061
(Continued)

(56) References Cited

U.S. PATENT DOCUMENTS 1,313,518 A 8/1919 Clark
4,013,556 A * 3/1977 Evans ..... B01D 24/14 210/136
(Continued)

FOREIGN PATENT DOCUMENTS

CN 1225714 A 8/1999
DE 102006011334 A1 * 9/2007 ..... F01P 11/0276
(Continued)

OTHER PUBLICATIONS

Shimoda, JP2000179987TRANS (English Translation), Jun. 2000.*
(Continued)

*Primary Examiner* — Eric Ruppert
(74) *Attorney, Agent, or Firm* — Hamre, Schumann, Mueller & Larson, P.C.

(57) ABSTRACT

Embodiments of a refrigerant distributor for a micro-channel heat exchanger (MCHEX) are described. The refrigerant distributor may be configured to have orifices and/or a flow valve that are inside a header of the MCHEX. The MCHEX can be used as an evaporator in a cooling cycle, where refrigerant is distributed into the header(s) through the orifices and the flow valve may be generally in a closed state that generally prevents a refrigerant flow through the flow valve. In a heating cycle, the flow valve of the refrigerant distributor may be configured to be in an open state that allows the refrigerant to flow into the refrigerant distributor and to be directed out of the MCHEX through the refrigerant distributor. In some embodiments, the refrigerant distributor
(Continued)

may be configured to receive liquid refrigerant, so as to eliminate the need of an expansion valve in a HVAC system.

6 Claims, 6 Drawing Sheets

(51) Int. Cl.
*F28F 27/02* (2006.01)
*F28D 1/053* (2006.01)

(52) U.S. Cl.
CPC ..... *F28F 9/0273* (2013.01); *F28F 9/0278* (2013.01); *F28F 27/02* (2013.01); *F28D 1/05375* (2013.01)

(58) Field of Classification Search
USPC ..... 165/174
See application file for complete search history.

(56) References Cited

U.S. PATENT DOCUMENTS

| | | | | |
|---|---|---|---|---|
| 5,727,626 | A | 3/1998 | Kato | |
| 5,806,586 | A | 9/1998 | Osthues et al. | |
| 5,826,649 | A | 10/1998 | Chapp et al. | |
| 2007/0039724 | A1 | 2/2007 | Trumbower et al. | |
| 2008/0093051 | A1 * | 4/2008 | Rios | F25B 41/067 165/61 |
| 2008/0296005 | A1 * | 12/2008 | Taras | F25B 13/00 165/173 |
| 2010/0089559 | A1 | 4/2010 | Gorbounov et al. | |
| 2011/0240276 | A1 | 10/2011 | Wintersteen et al. | |
| 2011/0290465 | A1 | 12/2011 | Joshi et al. | |

FOREIGN PATENT DOCUMENTS

| | | | | |
|---|---|---|---|---|
| FR | 2957411 | * | 9/2011 | |
| JP | 07-081383 | | 3/1995 | |
| JP | 2000179987 | * | 6/2000 | |
| JP | 2004101110 | * | 4/2004 | |
| SU | 478994 | * | 7/1975 | |
| WO | WO 2009076623 A1 | * | 6/2009 | F24F 1/0059 |

OTHER PUBLICATIONS

Ghiani Franco, DE102006011334A1TRANS (English Translation).*
Bauwens, FR2957411TRANS (English Translation), Sep. 2011.*
Ikezaki, JP2004101110TRANS (English Translation), Apr. 2004.*
Berezovsky, SU478994MT (English Translation), Jul. 1975.*
International Search Report and Written Opinion for International Application No. PCT/US2013/077062, dated Apr. 15, 2014, 13 pgs.

* cited by examiner

REFRIGERANT DISTRIBUTOR OF MICRO-CHANNEL HEAT EXCHANGER

FIELD OF TECHNOLOGY

Embodiments disclosed herein relate generally to a heat exchanger of a heating, ventilation and air conditioning (HVAC) system. More specifically, embodiments disclosed herein relate generally to distribution of a refrigerant in a micro-channel heat exchanger of a HVAC system.

BACKGROUND

A HVAC system commonly utilizes heat exchangers to help exchange heat between refrigerant and another fluid (such as air or water) moving through the heat exchangers. For example, during a cooling cycle, compressed refrigerant vapor is typically directed to a condenser. The condenser may be configured to facilitate heat exchange between the compressed refrigerant and the environment and condense the compressed refrigerant vapor into liquid refrigerant. The liquid refrigerant is then typically directed through an expansion valve to become a refrigerant vapor/liquid refrigerant mixture (two-phase refrigerant). The two-phase refrigerant is then typically directed into an evaporator, where the two-phase refrigerant exchanges heat with air in a room to be cooled. During the heat exchanging process, the two-phase refrigerant usually absorbs heat and is vaporized in the evaporator. The vaporized refrigerant is then directed back to the compressor.

Some HVAC systems are also configured to have a heating cycle. During a heating cycle, the process is usually reversed from the process in the cooling cycle. The evaporator functionally works as a condenser, and the condenser functionally works as an evaporator. After being compressed by the compressor, the compressed refrigerant vapor is typically directed to the evaporator first so as to release heat to the indoor air, which also condenses the refrigerant vapor to liquid refrigerant. The liquid refrigerant is then typically directed to the condenser to absorb heat from the environment and is vaporized. In the heating cycle, a direction of the refrigerant flow is typically reversed from a direction of the refrigerant flow in the cooling cycle.

Various types of heat exchangers have been developed to work as a condenser and/or an evaporator. One type of heat exchanger is a micro-channel heat exchanger (MCHEX). A typical MCHEX may include micro-channel tubes running in parallel between two headers. The adjacent tubes generally have fan-fold fins brazed in between. Refrigerant can be distributed into the micro-channel tubes from one of the headers. Outer surfaces of the micro-channel tubes and the fins may help heat exchange between the refrigerant in the micro-channel tubes and the environment.

SUMMARY

In a heat exchanger of a HVAC system, for example, a MCHEX, it may be difficult to optimally distribute refrigerant, for example in some cases evenly distribute the refrigerant to the tubes of the MCHEX. Embodiments described herein are directed to a refrigerant distribution structure that has an internal structure configured to extend inside a header of a MCHEX. The internal structure may include at least one orifice. The refrigerant distribution structure may be configured to receive refrigerant in a liquid state and deliver the liquid refrigerant to the orifice to distribute into the header of the MCHEX. This may help improve distribution of refrigerant to tubes of the MCHEX.

In some embodiments, a refrigerant distributor may have at least one orifice and at least one flow valve. At least a portion of the refrigerant distributor is configured to be positioned inside the header of the MCHEX. The orifice may be configured to allow refrigerant to flow through the orifice. The flow valve may have an open state and a closed state, where the open state may be configured to generally allow refrigerant to flow through the flow valve and the closed state may be configured to generally prevent a refrigerant flow through the flow valve.

The refrigerant distributor has a first end that may be configured to be connected to a refrigerant line. In some embodiments, the orifice(s) may be positioned on a sidewall of the refrigerant distributor. In some embodiments, a total number of orifices, a distance between two neighboring orifices and a diameter of each of the orifices may vary. In some embodiments, the distance between two neighboring orifices may be shorter as the locations of the orifices move away from the first end along the length of the refrigerant distributor. In some embodiments, the diameter of the orifices may become bigger as the locations of the orifices move away from the first end of the refrigerant distributor.

In some embodiments, the flow valve(s) may be positioned in the sidewall of the refrigerant distributor. In some embodiments, the flow valve(s) may be positioned closer to the first end than the orifice(s). In some embodiments, the flow valve(s) may be positioned at a second end of the refrigerant distributor, where the second end of the refrigerant distributor is generally at an opposite side in relation to the first end of the refrigerant distributor along a length of the refrigerant distributor.

In some embodiments, more than one flow valve may be positioned close to the first end of the refrigerant distributor. In some embodiments, the flow valves may be angularly staggered along a circumferential profile of the sidewall of the refrigerant distributor.

In some embodiments, the refrigerant distributor may include a tube-like structure extending inside the header of the MCHEX. A longitudinal end of the refrigerant distributor may be equipped with an orifice. In some embodiments, the header of the MCHEX may include a separate refrigerant outflow pipe that allows refrigerant to flow out of the header. In some embodiments, the outflow pipe may be equipped with a check valve.

In some embodiments, a portion of the header may be utilized to form the distribution structure. In some embodiments, the distribution structure may include an internal divider that divides the header into a first compartment and a second compartment. The internal divider may have one or more orifices so that refrigerant can be distributed from one compartment to the other compartment.

In use, a portion of the refrigerant distributor may be disposed inside a header of the heat exchanger so that the flow valve(s) and/or the orifice(s) may be positioned inside the header of the heat exchanger. In some embodiments, the heat exchanger may be used as an evaporator of a HVAC system. In a cooling mode, the flow valve(s) may be in the closed state. The refrigerant may be directed into the refrigerant distributor and exit the refrigerant distributor through the orifices(s) into the header. In some embodiments, the refrigerant directed into the refrigerant distributor may be in a liquid state. In a heating mode, the flow valve(s) may be configured in the open state to allow refrigerant to enter the refrigerant distributor through the flow valve(s) and be directed out of the refrigerant distributor.

BRIEF DESCRIPTION OF THE DRAWINGS

FIG. 3A is a perspective view of the refrigerant distributor and FIG. 3B is a schematic side sectional view of the micro-channel heat exchanger.

FIG. 7A is a schematic view. FIG. 7B is an end cross-section view along the line 7B-7B in FIG. 7A.

DETAILED DESCRIPTION

Figure 1:
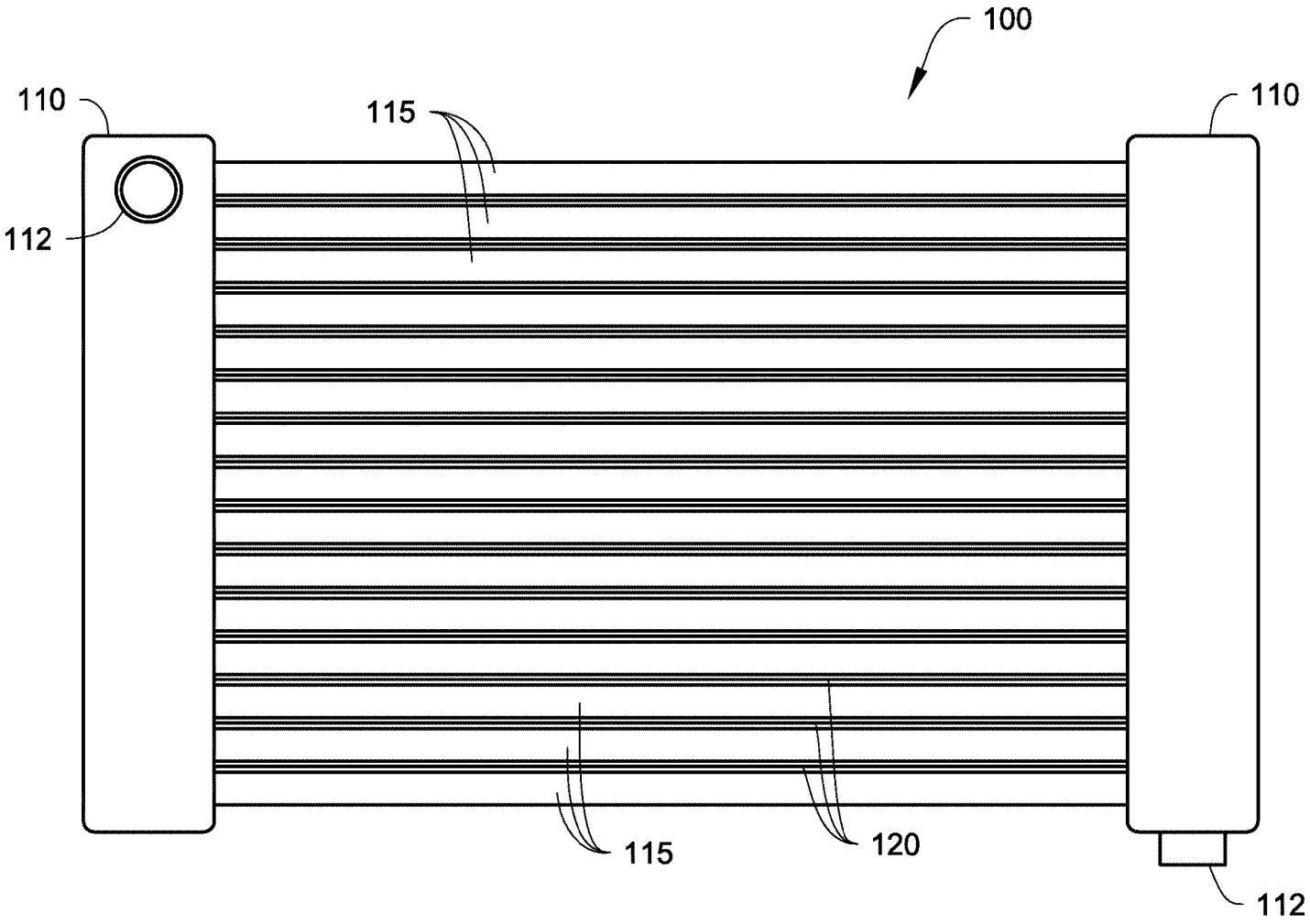
FIG. 1 illustrates a front view of an embodiment of a micro-channel heat exchanger.

Heat exchangers are used in a HVAC system to facilitate heat exchange between refrigerant and the environment. In a MCHEX, the refrigerant is typically distributed into tubes extending between two headers of the MCHEX, outer surfaces of the tubes and/or fins brazed between two neighboring tubes can help heat exchange between the refrigerant in the tubes and air moving through the outer surfaces of the tubes and/or the fins. In some cases, evenly distributing the refrigerant into the tubes of the MCHEX may help improve heat exchange efficiency of the MCHEX.

In a typical HVAC system, liquid refrigerant coming out of a condenser is generally directed through an expansion device (e.g. expansion valve) to become a two-phase refrigerant mixture. The two-phase refrigerant mixture may be then directed into an evaporator. When a MCHEX is used as an evaporator, it may be difficult to distribute the two-phase refrigerant mixture into tubes extending between headers of the MCHEX. The distribution of the two-phase refrigerant mixture in the MCHEX is a complex refrigerant flow regime. Poor distribution of the two-phase refrigerant mixture to the MCHEX header and/or subsequently into the tubes may reduce the overall thermal performance of the MCHEX and may also increase a pressure drop. The pressure drop may also contribute to uneven or less than desired or optimal distribution of the refrigerant liquid/vapor mixture. This issue may be more prominent when the tubes are relatively long. Improvements can be made to help distribute refrigerant in the MCHEX, for example, in some cases distribute refrigerant more evenly in the MCHEX.

In the following description of the illustrated embodiments, embodiments of a refrigerant distribution structure for a MCHEX are described. The refrigerant distribution structure generally may include a structure that is configured to be disposed inside a header of the MCHEX. The internal structure of the distribution structure may include one or more orifices that can be used to distribute the refrigerant inside the header. In some embodiments, the MCHEX may also be configured to have a flow valve disposed inside the header of the MCHEX on the internal structure. The flow valve may be configured to allow refrigerant to flow out of the header. In some embodiments, the flow valve can be positioned outside of the header on a separate refrigerant outflow pipe connecting the header. In some embodiments, when the MCHEX is used, for example, as an evaporator in a cooling cycle, refrigerant is distributed into the header(s) through the orifices. In the cooling cycle, the flow valve may be generally in a closed state that generally prevents a refrigerant flow through the flow valve. In some embodiments, when the MCHEX is in, for example, a heating cycle, the flow valve of the refrigerant distribution structure may be configured to be in an open state that allows the refrigerant to flow into the refrigerant distribution structure (or the refrigerant outflow pipe) and to be directed out of the MCHEX through the refrigerant distribution structure. In some embodiments, the flow valve may be a check valve. In some embodiments, the refrigerant distributor may be configured to receive liquid refrigerant, so as to eliminate the need of a refrigerant expansion valve in the HVAC system.

References are made to the accompanying drawings that form a part hereof, and in which is shown by way of illustration of the embodiments may be practiced. It is to be understood that the terms used herein are for the purpose of describing the figures and embodiments and should not be regarded as limiting the scope of the present application. The term "refrigerant" generally refers to refrigerant in any state, for example refrigerant in vapor state (or refrigerant vapor) or in liquid state (or liquid refrigerant). It is to be noted that the states of the refrigerant is dynamic. The terms "liquid refrigerant," "refrigerant vapor," "refrigerant in a liquid state," "refrigerant in a vapor state" are not absolute terms. The refrigerant can change between the vapor state and the liquid state constantly. Therefore, the liquid refrigerant may include some refrigerant vapor and the refrigerant vapor may include some liquid refrigerant. The terms "two-phase refrigerant mixture" generally refers to a state after the liquid refrigerant is expanded by an orifice or an expansion valve. The "two-phase refrigerant mixture" generally has a lower temperature compared to refrigerant vapor or liquid refrigerant in the HVAC system. These terms are generally well known in the art.

FIG. 1 illustrates a MCHEX 100, with which embodiments as described herein can be practiced. The MCHEX 100 includes two opposing headers 110. The headers 110 have refrigerant ports 112 that are generally configured to allow refrigerant to enter and/or exit the headers. The refrigerant ports 112 may be generally configured to be connected to refrigerant lines of a HVAC system (not shown). Tubes 115 are configured to extend between the two opposing headers 110. Areas between neighboring tubes 115 may be configured to include fins 120, for example, fan-fold fins.

In operation, refrigerant can enter one of the headers 110 through one of the refrigerant ports 112. The refrigerant can then be distributed from the header 110 into the tubes 115. The refrigerant may be then directed toward the other header 110 and exit from the other refrigerant port 112. Surfaces of the tubes 115 and the fins 120 may be configured to be capable of conducting heat. The refrigerant in the tubes 115 can exchange heat with air passing through the surfaces of the tubes 115 and/or the fins between the neighboring tubes 115.

It is to be appreciated that the MCHEX 100 as illustrated in FIG. 1 is one example of a heat exchanger that can be used with the embodiments of the refrigerant distributor as described herein. Embodiments of the refrigerant distributor as described herein may also be used with other heat exchangers to help, for example, distribute refrigerant into the heat exchange tubes.

Figure 2:
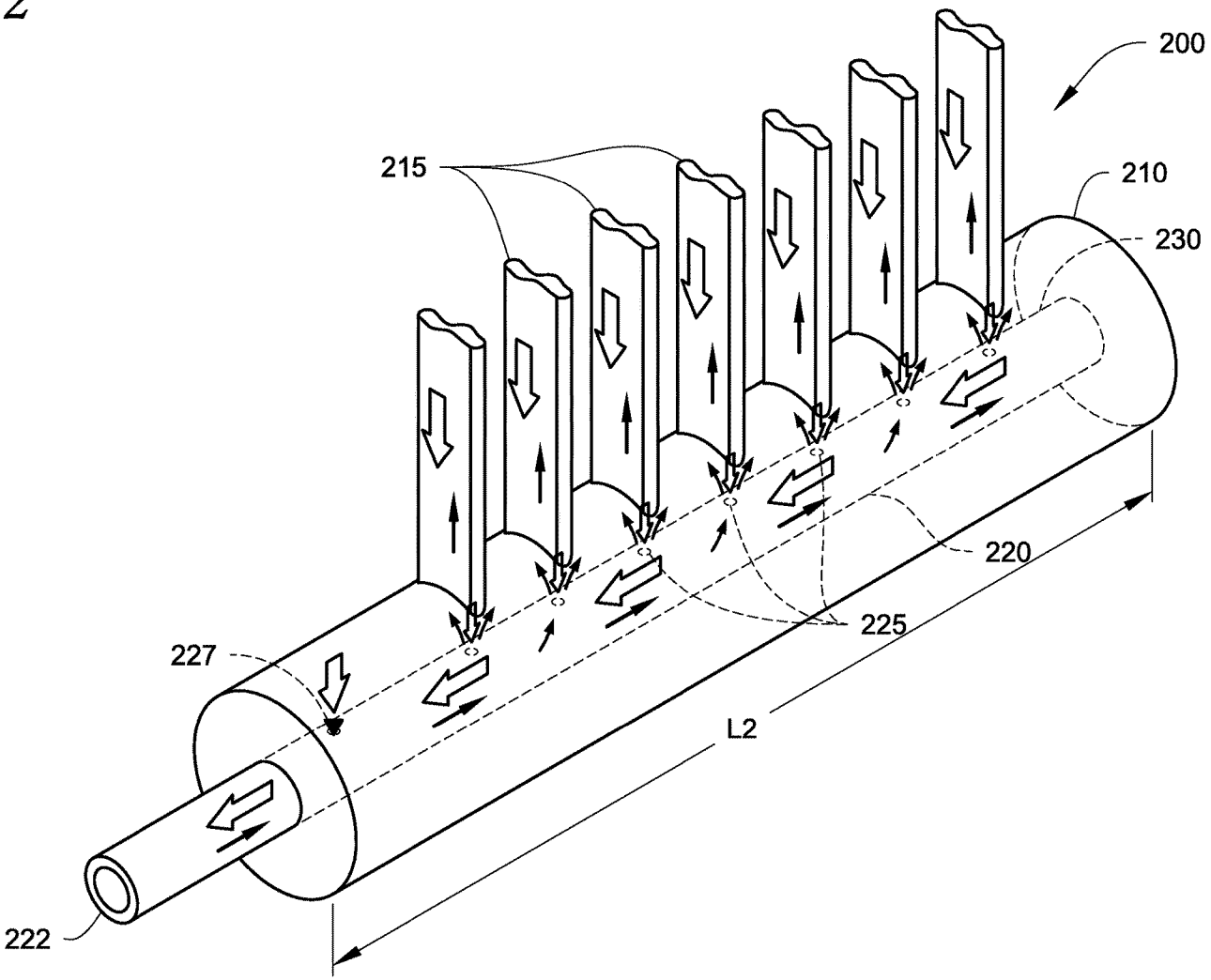
FIG. 2 illustrates a schematic view of a portion of a micro-channel heat exchanger that is equipped with an embodiment of a refrigerant distributor inside a header of the micro-channel heat exchanger.

FIG. 2 illustrates a portion of a MCHEX 200, where a header 210 of the MCHEX 200 is equipped with an embodiment of a refrigerant distributor 220 as described herein. The refrigerant distributor 220 may be a tube-like structure. The header 210 is coupled with tubes 215 that extend between the header 210 and an opposing header (not shown in this figure).

A portion of the refrigerant distributor 220 extends into the header 210 in a longitudinal direction that is defined by a length L2 of the header 210. In some embodiments, the refrigerant distributor 220 may extend the full length L2 of the header 210. In some embodiment, the refrigerant distributor 220 may not extend the full length L2 of the header 210. The refrigerant distributor 220 may be generally configured to be hollow internally and allow refrigerant to flow along the refrigerant distributor 220 internally. An end 222 of the refrigerant distributor 220 may be configured to be connected or in fluid communication with a refrigerant line of a HVAC system (not shown). The refrigerant distributor 220 may also include one or more orifices 225 that are generally configured to allow refrigerant to exit and/or enter the refrigerant distributor 220 along the internal portion of the refrigerant distributor 220 that extends into the header 210. In the embodiment as shown in FIG. 2, the orifices 225 are configured to be located on a portion of a sidewall 230 of the refrigerant distributor 220 that generally faces openings of the tubes 215 inside the header 210.

In the illustrated embodiment, the refrigerant distributor 220 also includes a flow valve 227. The flow valve 227 may be configured to have an open state and a closed state, where the open state generally allows refrigerant to flow into or out of the refrigerant distributor 220 through the flow valve 227 and the closed state generally prevents a refrigerant flow through the flow valve 227. In some embodiments, the flow valve 227 and the orifices 225 are generally configured to be disposed within the header 210.

Black arrows and block white arrows generally illustrate directions of refrigerant flows in the MCHEX 200, when the MCHEX 200 is used in a HVAC system in operation. The black arrows generally indicate the refrigerant flow directions in the MCHEX 200 in a cooling cycle; and the block white arrows generally indicated the refrigerant flow directions in the MCHEX 200 in a heating cycle.

As illustrated by the black arrows, in a cooling cycle, refrigerant is directed into the refrigerant distributor 220 through the end 222. In some embodiments, the end 222 may be configured to receive liquid refrigerant produced by a condenser upstream of the MCHEX 200 without going through an expansion valve. When the refrigerant passes through the orifices 225 into the header 210 en route to the tubes 215, the refrigerant can be expanded to a lower pressure two-phase refrigerant. The orifices 225 function to provide refrigerant expansion, which may eliminate the need for an external refrigerant expansion valve.

Since the orifices 225 are positioned inside the header 210 and spaced out along the longitudinal direction defined by the length L2, refrigerant (such as the liquid refrigerant from a condenser) can be distributed along the sidewall 230 in the longitudinal direction that is defined by the length L2, and pass through the orifices 225 to be distributed to the tubes 215. Directing refrigerant in a liquid state to the refrigerant distributor 220 in the longitudinal direction defined by the length L and into the tubes 215 through the orifices 225 may help provide optimal and in some cases even distribution of the refrigerant to the tubes 215.

In the cooling mode, the flow valve 227 is generally in a closed state that generally prevents refrigerant from flowing back into the refrigerant distributor 220 through the flow valve 227. In some embodiments, the flow valve 227 can be a check valve. In the cooling mode, a pressure of the refrigerant in the refrigerant distributor 220 may be higher than a pressure of the refrigerant in the header 210. The pressure difference can press the check valve type flow valve 227 so that the flow valve 227 is maintained in the closed state.

In the heating mode, the refrigerant flow directions are generally reversed from the refrigerant flow directions in the cooling mode. As shown by the block white arrows, in the heating mode, the refrigerant is generally directed into the tubes 215 from the header that is on the opposite side of the header 210. The refrigerant is then generally directed out of the MCHEX 200 through the refrigerant distributor 220.

In some embodiments, the orifices 225 may be configured to allow at least some of the refrigerant to enter the refrigerant distributor 220 in the heating mode. The flow valve 227 can also be configured to be in the open state to allow refrigerant to enter the refrigerant distributor 220. The refrigerant can exit the refrigerant distributor 220 through the end 222. In the heating mode, the refrigerant pressure in the header 210 is generally higher than the refrigerant pressure in the refrigerant distributor 220. When a check valve is used as the flow valve 227, the check valve can be configured to be opened by the relative pressure difference. The open state of the flow valve 227 can allow the refrigerant to exit the header 210 and the refrigerant distributor 220 relatively quickly.

It is to be noted that the orifices 225 may allow refrigerant to flow in and out of the refrigerant distributor 220. Therefore, in some embodiments, the refrigerant distributor 220 may not have the flow valve 227. For example, in some embodiments, when the orifices can allow enough refrigerant flow into the refrigerant distributor in a heating mode (such as illustrated by the block white arrow above), a flow valve(s), such as the flow valve 227, may not be required.

Figure 3B:
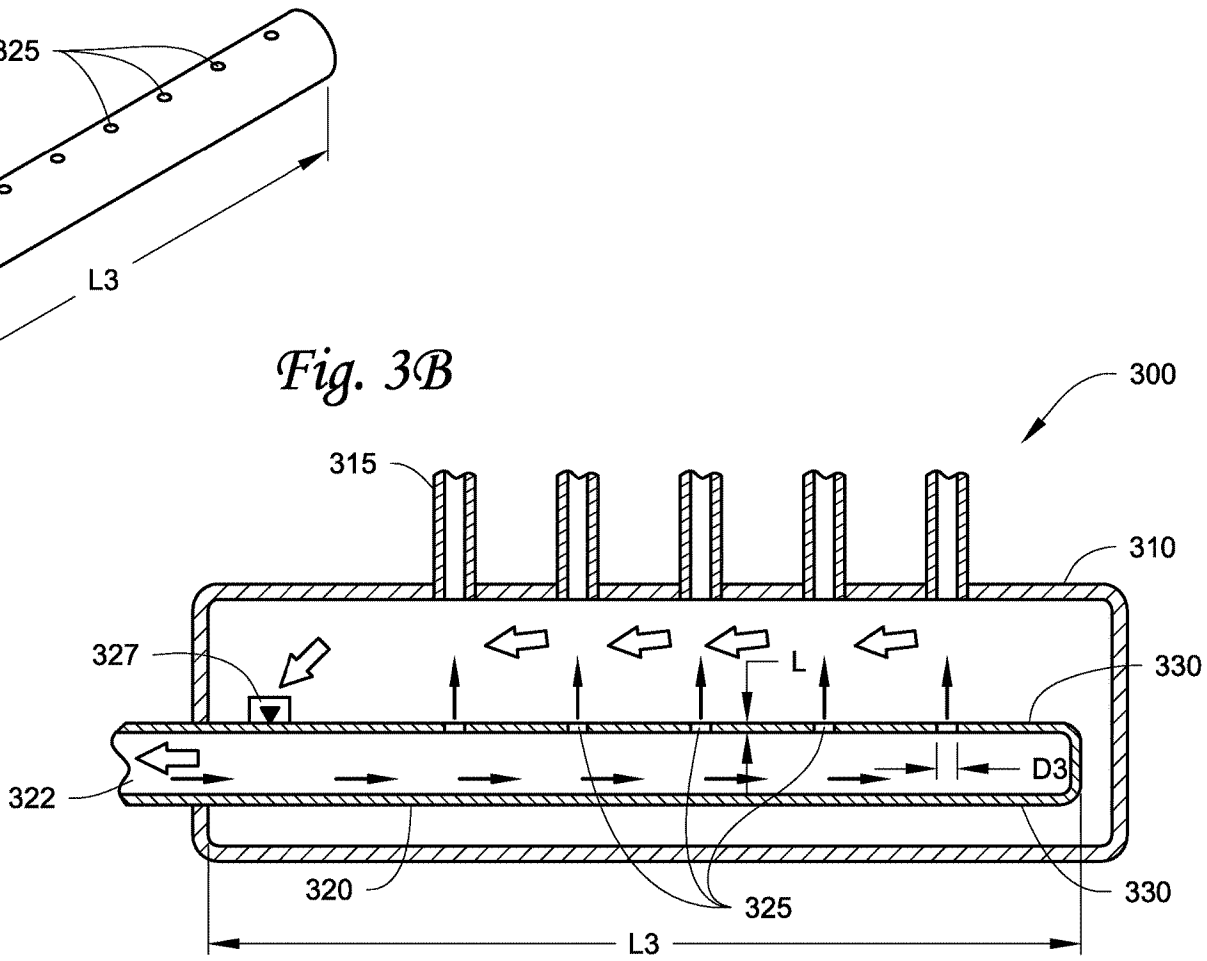
FIGS. 3A and 3B illustrate an embodiment of a refrigerant distributor that can be configured to extend inside a header of a micro-channel heat exchanger.
Figure 3A:
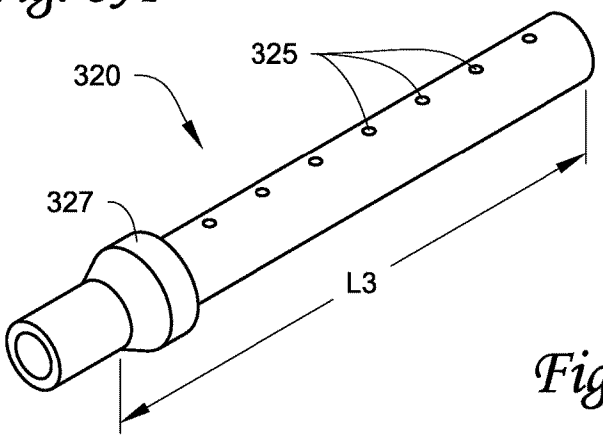

FIGS. 3A and 3B illustrate another embodiment of a tube-like refrigerant distributor 320 of a MCHEX 300. FIG. 3A is a perspective view of the refrigerant distributor 320. FIG. 3A illustrates that the refrigerant distributor 320 has a plurality of orifices 325 along a portion of the refrigerant distributor 320 that is typically configured to be disposed inside a header 310 (as shown in FIG. 3B). The portion that is configured to be disposed inside the header 310 has a length L3. The refrigerant distributor 320 also has a flow valve 327.

FIG. 3B is a schematic sectional view of the header 310 of a MCHEX 300, in which the header 310 is equipped with the refrigerant distributor 320 as shown in FIG. 3A. FIG. 3B illustrates that the flow valve 327 and orifices 325 are both positioned inside the header 310 of the MCHEX 300, and on a sidewall 330 of the refrigerant distributor 320. Refrigerant can flow in and/or out of the refrigerant distributor 320 from a distributor end 322. FIG. 3B also illustrates portions of tubes 315.

In operation, when the MCHEX 300 is used as, for example, an evaporator for a HVAC system, black arrows and block white arrows generally indicate refrigerant flow direction in a cooling mode and a heating mode respectively. As illustrated, in the cooling mode, the refrigerant can exit from the refrigerant distributor 320 through the orifices 325. Generally in the cooling mode, the flow valve 327 is in a closed state that generally does not allow refrigerant to flow through the flow valve 327. In a heating mode, the flow valve 327 is in an open state that generally allows refrigerant flow through the flow valve 327. The refrigerant can enter the refrigerant distributor 320 through the flow valve 327 and flow out of the MCHEX 300.

The orifices 325 can be holes drilled on the refrigerant distributor 320, thick wall tubing or pipes, caterpillar pipes, or other suitable configurations that allow refrigerant to flow out of the refrigerant distributor 320. The orifices 325 are configured to be spaced out along the length L3. In the illustrated embodiment in FIG. 3B, the orifices 325 are generally located on a portion of the sidewall 330 that generally faces openings of the tubes 315 inside the header 310. The shapes of the orifices 325 can be varied. The locations of the orifices 325 can be varied along the length L3, and/or along a circumferential profile of the sidewall 330. (See, for example, in FIG. 5 the sidewall 530 has a circumferential profile.) Generally, the locations, numbers and shapes of the orifices 325 can be varied to achieve a desired refrigerant distribution in the header 310.

The number of the orifices 325 on the refrigerant distributor 320 may vary. If more refrigerant is required, the number of orifices 325 can be increased. In addition, the positions of the orifices 325 can vary. In some embodiments, each of the tubes 315 may be configured to correspond to one orifice 325 that is configured to be positioned in an area that is directly underneath the tube 315, with the understanding that the positions of the orifices 325 can also be positioned offset the tubes 315. Further, a distance between neighboring orifices 325 can vary. In some embodiments, neighboring orifices 325 can be configured to be closer when the locations of the orifices 325 are further away from the end 322 of the refrigerant distributor 320 along the length L3. This may help refrigerant distributing in the header 310, as more refrigerant may come out of the orifices 325 that are closer to the end of the refrigerant distributor 320 configured to receive the refrigerant (e.g. the end 322).

Each of the orifices 325 has a diameter D3. The diameter D3 of the orifices 325 can affect an amount of refrigerant coming out of the orifices 325. Particularly in a cooling cycle, it may be desirable to control the amount of refrigerant coming out of the orifices 325. One way to control the amount of refrigerant coming out of the orifices 325 is to control the diameter D3 of each of the orifices 325 and/or change a length L of the orifice 325. In general, the amount of the refrigerant coming out of an orifice is affected by length-to-diameter (L/D) ratio. Changing the diameter D3 of the orifices 325 can change the L/D ratio of the orifices 325, causing changes to the amount of the refrigerant coming out of the orifices 325. Generally, the bigger the diameter (the less the L/D ratio) is, the more refrigerant comes out of the orifices 325. The diameter D3 of the orifices 325 can vary. In some embodiments, all of the orifices 325 can have the same diameter D3. In some embodiments, the diameter D3 of each of the orifices can be different. In some embodiments, the diameter D3 of the orifices 325 becomes larger when the locations of the orifices 325 move away from the end 322 of the refrigerant distributor 320 along the length L3. The length L of the orifices 325 can be changed, for example, by changing the thickness of the refrigerant distributor 320. In some embodiments, the length L of the orifices is about ¾ inch. The L/D ratio, and/or the total number of the orifices 325 can be determined, for example, by total maximum and minimum flow rates of the refrigerant used by the MCHEX.

Figure 4:
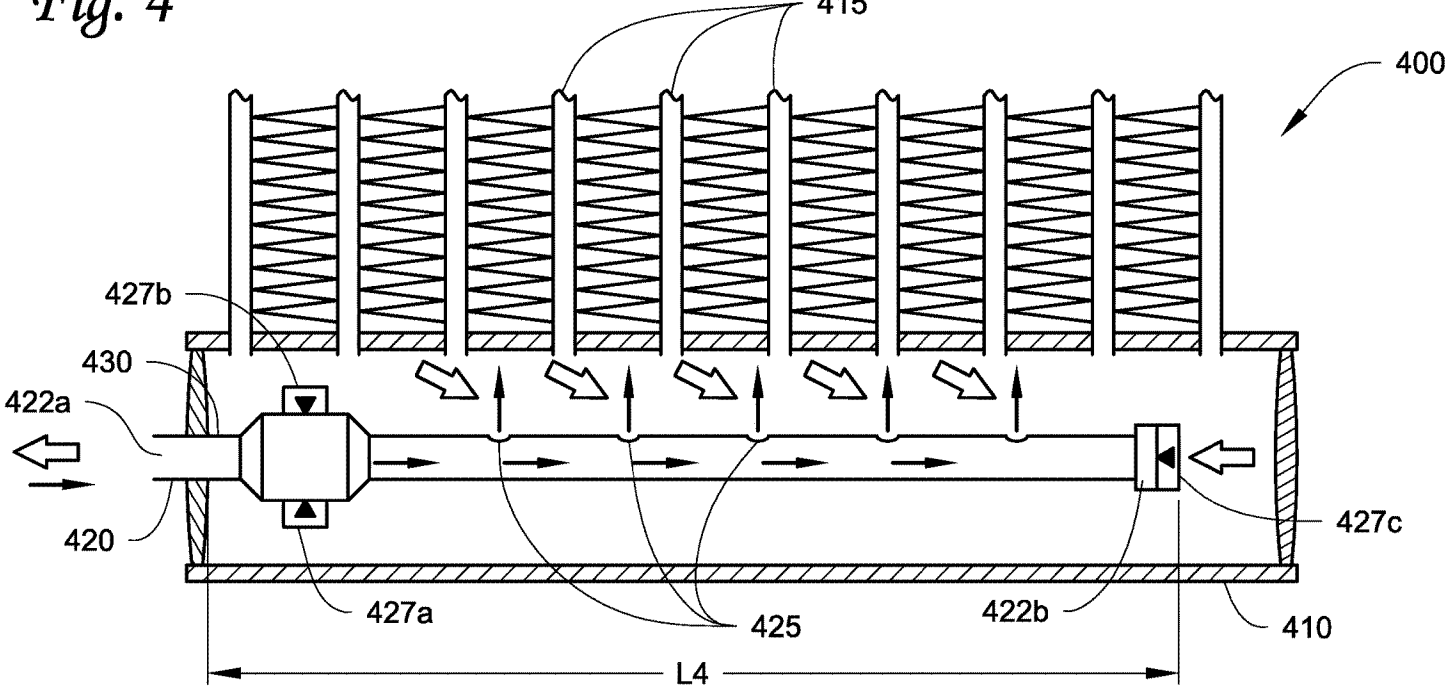
FIG. 4 illustrates a side sectional view of another embodiment of a micro-channel heat exchanger equipped with a refrigerant distributor inside a header of the micro-channel heat exchanger.

FIG. 4 illustrates another embodiment of a refrigerant distributor 420 that can be used with a MCHEX 400. The refrigerant distributor 420 extends into a header 410. A portion of the refrigerant distributor 420 that extends inside the header 410, which has a length of L4, can have a plurality of orifices 425 and a plurality of flow valves 427*a*, 427*b* and 427*c* along the length L4. The refrigerant distributor 420 has a first end 422*a* that can be configured to be connected to a refrigerant line of a HVAC system, and a second end 422*b* that can be equipped with the flow valve 427*c*. The second end 422*b* is generally on an opposite side in relation to the first end 422*a* of the length L4.

In the embodiment shown, the flow valves 427*a* and 427*b* can be positioned in an area that is close to the first end 422*a* within the header 410. The flow valve 427*c* can be positioned close to (or at) the second end 422*b*. In some embodiments, each end may include only one flow valve. Positioning the valves (such as the flow valves 427*a*, 427*b* and 427*c*) at both ends of the distributor can help reduce a pressure drop when the refrigerant flows into the distributor, for example, in a heating mode.

It is to be understood that the configuration as illustrated in FIG. 4 is exemplary. The refrigerant distributor 420 can be configured to have only one flow valve. The locations of the flow valves can be located near either the first ends 422*a*, or the second end 422*b* of the refrigerant distributor 420. It may be preferred include a flow valve(s) at both of the first end 422*a* and second end 422*b* with the flow valves (e.g. the flow valves 427*a*, 427*b* and 427*c*), because equipping both ends 422*a* and 422*b* may help reduce a pressure drop when the refrigerant flowing into the refrigerant distributor 420 through the flow valves.

As illustrated in FIG. 4, two or more flow valves 427*a* and 427*b* can be positioned on a shell 430 of the refrigerant distributor 420 at a place that is close to the first end 422*a* of the refrigerant distributor 420. The flow valves 427*a* and 427*b* are roughly arranged to face each other from opposite sides of a shell 430 of the refrigerant distributor 420 in relation to openings of the tubes 415. Positioning two or more flow valves (such as, for example, the flow valves 427*a* or 427*b* and 427*c*) on opposite (or different) sides of the shell 430 may help reduce a pressure drop when the refrigerant flowing into the refrigerant distributor 420 through the valves.

It is to be noted that in some embodiments, the flow valve may be positioned between orifices. Generally, the flow valves may be configured to provide a refrigerant flow path that allows relatively fast refrigerant flow and/or minimal pressure drops in the refrigerant flow. In some embodiments, the flow valve may be configured so that the refrigerant flowing through the flow valve does not generally change from one state to another (e.g. from liquid state to two-phase state).

Figure 5:
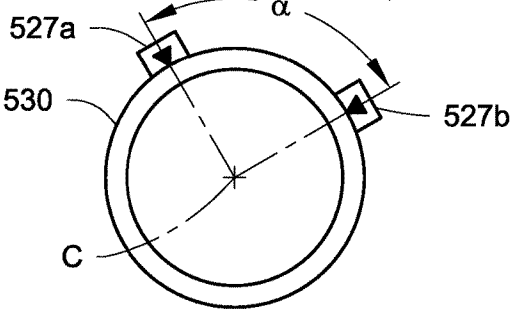
FIG. 5 illustrates an end view of another embodiment of a refrigerant distributor.

As illustrated in FIG. 5, which shows an end view of a refrigerant distributor 520, flow valves 527*a* and 527*b* can be staggered at an angle $\alpha$ on a circumferential profile of the sidewall 530 of the refrigerant distributor 520 relative to a center C of the circumferential profile. In the illustrated embodiment, the angle $\alpha$ is about 45 degrees. It is to be understood that the angle can be in a range of 0 to 180 degrees.

Figure 6:
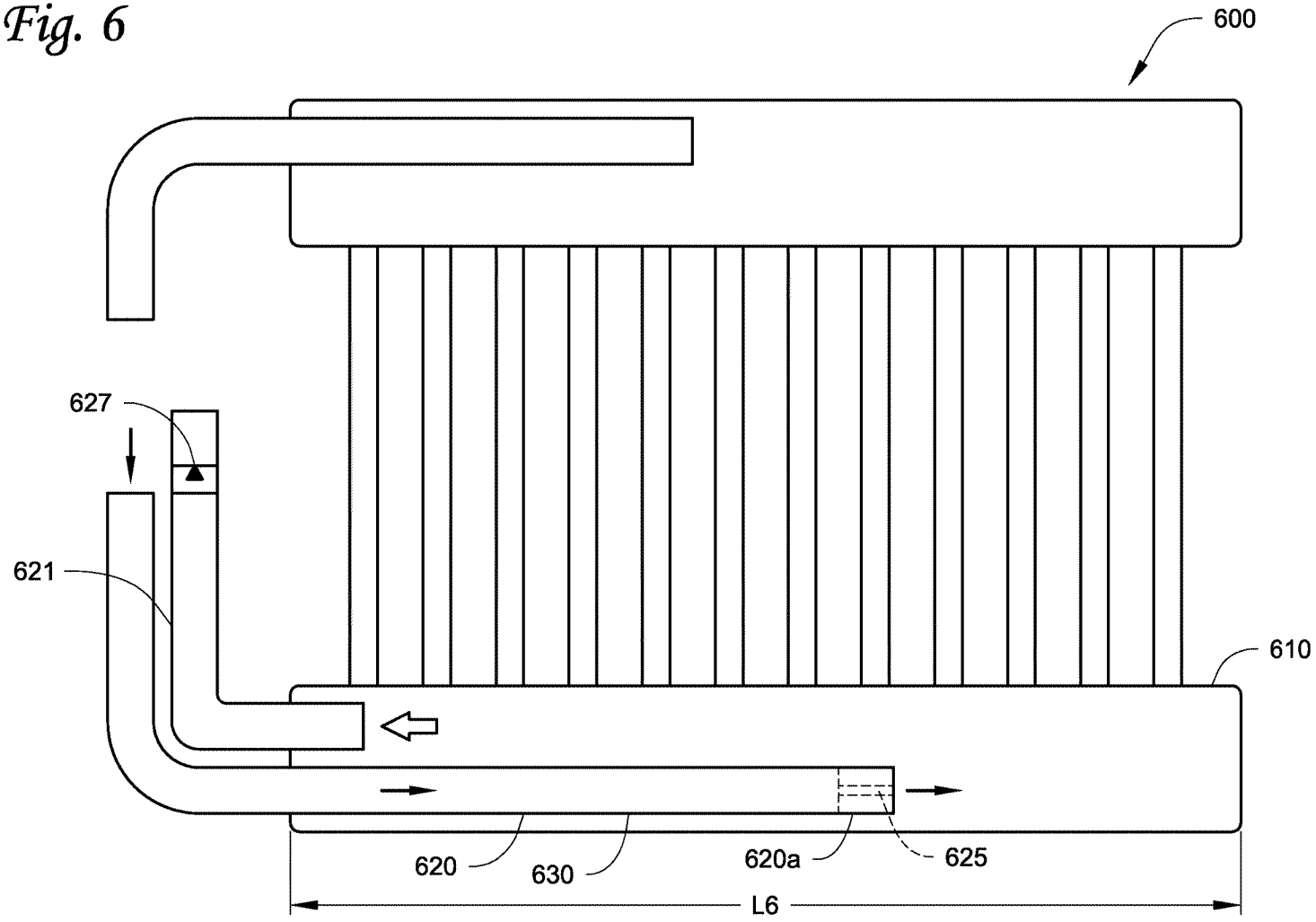
FIG. 6 illustrates yet another embodiment of a micro-channel heat exchanger.

FIG. 6 illustrates another embodiment of MCHEX 600. The MCHEX 600 includes a header 610 that has a length L6, which defines a longitudinal direction. The MCHEX 600 includes a tube-like refrigerant distributor 620 extending inside the header 610 in the longitudinal direction that is defined by the length L6. The refrigerant distributor 620 can be configured so that a longitudinal end 620*a* of refrigerant distributor 620 is equipped with one orifice 625, while a sidewall 630 of the refrigerant distributor 620 does not have orifices.

Positioning the orifice 625 inside the header 610 can improve refrigerant distribution in the header 610. Particularly, if the MCHEX 600 has a relatively small capacity or size, using one orifice 625 and positioning the orifice 625 inside the header 610 may be sufficient to provide a desired refrigerant distribution in the MCHEX 600. It is appreciated that a position of the longitudinal end 620*a* along the longitudinal direction defined by the length L6 may be varied to achieve a desired refrigerant distribution. It is appreciated that the sidewall 630 can be configured to have orifices.

The header 610 of the MCHEX 600 also includes a refrigerant outflow pipe 621, which is configured to direct refrigerant out of the header 610 of the MCHEX 600. The outflow pipe 621 can be configured to include a check valve 627. In the embodiment as disclosed in FIG. 6, the refrigerant outflow pipe 621 is separate from the refrigerant distributor 620. The refrigerant outflow pipe 621 can be configured to direct refrigerant out of the header 610, for example, in a heating mode.

It is appreciated that the refrigerant distributor 620 can also be equipped with a check valve, so that a separate refrigerant outflow pipe 621 may not be necessary. It is also appreciated that the other embodiments as disclosed herein can also be equipped with a separate refrigerant outflow pipe, such as the refrigerant outflow pipe 621, that is equipped with at least one check valve (such as the check valve 627) to direct refrigerant out of the header, for example, in a heating mode. A check valve(s) on the refrigerant distributor may not be necessary in an embodiment with a separate refrigerant outflow pipe equipped with a check valve(s).

Figure 7A:
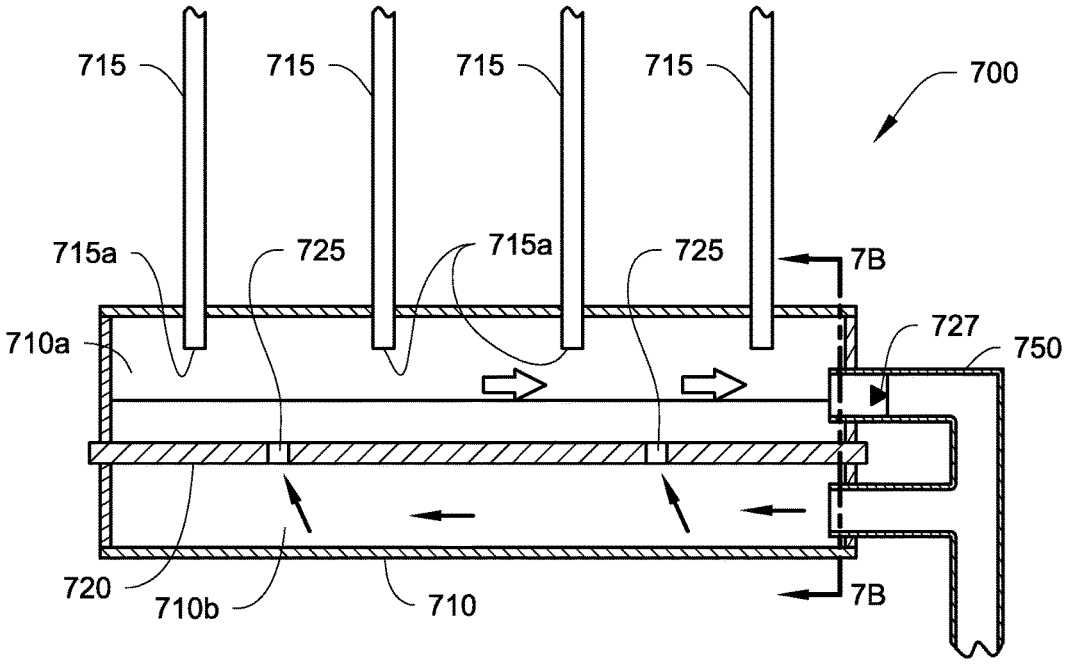
FIGS. 7A and 7B illustrate different views of a micro-channel heat exchanger, according to another embodiment.
Figure 7B:
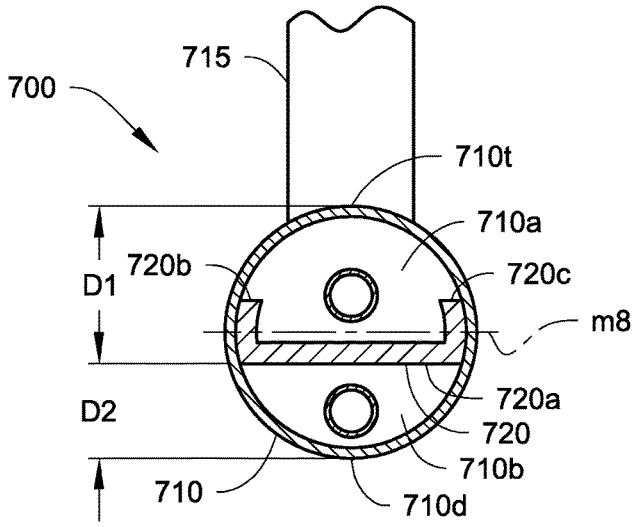

FIGS. 7A and 7B illustrate another embodiment of MCHEX 700. The MCHEX 700 includes a header 710 that is divided into a first compartment 710*a* and a second compartment 710*b* by a divider 720. The divider 720 can act as the refrigerant distributor, where a portion of the wall of the header may be used as part of the structure. As illustrated, portions of the header 710 are used with the divider 720 to form the first compartment 710*a* and the second compartment 710*b* (see also FIG. 7B). Open ends 715*a* of tubes 715 are configured to open into the first compartment 710*a*. The first compartment 710*a* is configured to receive refrigerant, for example in a heating mode, and direct the refrigerant out of the header 710 into a refrigerant pipe 750. The refrigerant pipe 750 can include a check valve 727.

In some embodiments, the divider 720 has one or more orifices 725. The second compartment 710*b* is configured to receive refrigerant, for example, in a cooling mode, from the refrigerant pipe 750. The refrigerant can be distributed into the first compartment 710*a* and the tubes 715 through the orifices 725. Functionally, the second compartment 710*b*, which includes a portion of the header 710 and the divider 720, works similarly to the refrigerant distributor as disclosed, for example, in FIG. 2.

The refrigerant pipe 750 can be configured to direct refrigerant toward the header 710, for example, in a cooling mode; and can be configured to direct refrigerant away from the header 710, for example, in a heating mode. The check valve 727 can be configured to close, for example, in the cooling mode, so that the refrigerant is directed into the second compartment 720*b* in the heating mode. The check valve 727 can be configured to open, for example, in the heating mode, so that the refrigerant can be directed out of the first compartment 710*a*.

FIG. 7B illustrates a cross-section view of the MCHEX 700 along the line 7B-7B. The header 710 typically has a circular profile in the cross-section view. In the orientation as shown in FIG. 7B, a top portion 710*t* of the circular profile of the header 710 is connected to the tube 715. A bottom portion 710*d* of the circular profile of the header 710 is opposite to the top portion 710*t* along the circular profile of the header 710.

In some embodiments, the divider 720 is positioned so that a bottom 720*a* is closer to the bottom portion 710*d* than to the top portion 710*t*. As illustrated in FIG. 7B, a distance D1 between the bottom 720*a* to the top portion 710*t* is larger than a distance D2 between the bottom 720*a* to the bottom portion 710*d*.

In some embodiments, from the cross-section view, the divider 720 has raised edges 720*b* and 720*c*. The edges 720*b* and 720*c* are configured to engage and conform to an arc of the circular profile of the header 710. Lengths of the edges 720*b* and 720*c* are configured so that the engagement of the edges 720*b* and 720*c* and the arc of the circular profile of the header 710 can provide a support to the divider 720 so as to resist pressure in the first compartment 710*a* and/or in the second compartment 710*b*. Generally, the lengths of the edges 720*b* and 720*c* are configured so that the edges 720*b* and 720*c* traverse a midline m8 of the circular profile of the header 710 in the orientation as shown in FIG. 7B. The midline m8 is generally situated in the middle between the top portion 710*t* and the bottom portion 710*d* of the header 710 in the cross-section view.

In some embodiments, the lengths of the edges 720*b* and 720*c* correspond to about ±10° of the arc of the circular profile of the header 710 relative to the midline m8.

The embodiments as disclosed herein are exemplary. Generally, a refrigerant distribution structure can be configured to include an internal structure, which is configured to extend inside a header of the MCHEX. In some embodiments, the internal structure may be a tube-like structure. The internal structure can include at least one orifice. Positioning the orifice inside the header of the MCHEX can help distributing of the refrigerant inside the header of the MCHEX. The internal structure can be configured to include a plurality of orifices. The refrigerant distribution structure may also include a check valve. The check valve is configured to allow refrigerant to flow out of the header, such as, for example, in a heating mode. The check valve can be positioned on the internal structure. In some embodiments, the check valve can be positioned in a refrigerant outflow pipe that is separate from the internal structure. In some embodiments, the internal structure may be a divider that divides the header into a first compartment and a second compartment. The distribution structure may utilize a portion of the header to distribute and/or collect refrigerant. In operation, for example, in a cooling mode, the orifice is generally configured to distribute the refrigerant internally into tubes of the MCHEX while the check valve is in a closed state. In a heating mode, for example, the check valve is generally in an open state that is configured to allow refrigerant to flow out of the header of the MCHEX. In operation, liquid refrigerant can be directed into the internally positioned orifice(s) through the internal structure. Liquid refrigerant can then go through the orifice(s) to be distributed into tubes of the MCHEX. This may help evenly distribute the refrigerant and eliminate the need for an additional expansion valve.

It is to be appreciated that the embodiments of the refrigerant distributors as described herein can be used in a condenser and/or other heat exchange applications. It is also appreciated that the refrigerant distributor as described herein can be used in applications other than a HVAC system, such as a transport refrigeration system or other heat exchanging applications that may benefit from evenly distributed two-phase refrigerant mixture.

The embodiments as disclosed herein are generally described to evenly distribute refrigerant into the tubes of the MCHEX. It is to be understood that this is exemplary. The embodiments as disclosed can also be adapted to help distribute the refrigerant into the tubes of the MCHEX in other desired patterns. In some embodiments, an optimal or desired distribution of refrigerant into the tubes of the MCHEX may not be even distribution. For example, when airflow moving through the MCHEX is not uniform, tubes in one portion of the MCHEX receiving a relatively high amount of airflow may be configured to receive more refrigerant than the tubes in another portion of the MCHEX receiving a relatively low amount of airflow.

Aspects

Any of aspects 1-5 can be combined with any of aspects 6-25. Any of aspects 6-12 can be combined with any of aspects 13-25. Any of aspects 13-18 can be combined with any of aspects 19-25. Any of aspects 19-21 can be combined with any of aspects 22-25.

Aspect 1. A HVAC system comprising:

a first heat exchanger configured to condense gaseous refrigerant to liquid refrigerant; and a second heat exchanger, the second heat exchanger having a header; and a refrigerant distributor extending inside the header, the refrigerant distributor having a first end and a second end;

wherein the refrigerant distributor is configured to receive liquid refrigerant from the first end in a cooling mode;

the refrigerant distributor has a plurality of orifices between the first end and the second end;

the refrigerant distributor has a flow valve at the second end of the refrigerant distributor;

the flow valve is configured to be in a closed state that prevents refrigerant flow through the first flow valve in a cooling mode, and in an open state that allows refrigerant to flow though the flow valve in a heating mode.

Aspect 2. The HVAC system of aspect 1, further comprising:

a second flow valve;

wherein the second flow valve is positioned at the first end of the refrigerant distributor;

the second flow valve is configured to be in a closed state that prevents refrigerant flow through the first flow valve in a cooling mode, and in an open state that allows refrigerant to flow though the flow valve in a heating mode.

Aspect 3. The HVAC system of aspect 2, wherein the second flow valve is positioned on a side wall of the refrigerant distributor.

Aspect 4. The HVAC system of aspects 1-3, wherein the flow valve is a check valve.

Aspect 5. The HVAC system of aspects 1-4, wherein a distance between two neighboring orifices decreases as the orifices are further away from the first end.

Aspect 6. A refrigerant distributor of a heat exchanger comprising:

a tube having plurality of orifices; and a flow valve having an open state and a closed state;

wherein the closed state of the flow valve is configured to generally prevent refrigerant flow through the flow valve into the tube, and the open state of the first flow valve is configured to generally allow refrigerant to flow through the first flow valve into the tube.

Aspect 7. The refrigerant distributor of aspect 6, wherein a first end of the tube of the refrigerant distributor is configured to receive refrigerant, and the first flow valve is closer to the first end than the plurality of orifices.

Aspect 8. The refrigerant distributor of aspects 6-7, wherein the flow valve is positioned on a sidewall of the tube.

Aspect 9. The refrigerant distributor of aspects 6-8, further comprising:

a second flow valve;

wherein a first end of the tube of the refrigerant distributor is configured to receive refrigerant, and the flow valve and the second flow valves are positioned closer to the first end than the plurality orifices;

the flow valve and second flow valves are staggered at an angle around a circumferential profile of the sidewall of the tube of the refrigerant distributor.

Aspect 10. The refrigerant distributor of aspects 6-9, wherein a first end of the tube of the refrigerant distributor is configured to receive refrigerant, and the flow valve is positioned further away from the first end of the tube of the refrigerant distributor than the orifices.

Aspect 11. The refrigerant distributor of aspect 10, further comprising:

a second flow valve, wherein the second flow valve is positioned closer to the first end of the tube of the refrigerant distributor than the orifices.

Aspect 12. The refrigerant distributor of aspects 6-11, wherein the tube of the refrigerant distributor has a first end and a second end, the first end is configured to receive refrigerant, and the first flow valve is positioned at the second end of tube of the refrigerant distributor.

Aspect 13. A heat exchanger, comprising:

a header;

a refrigerant distributor, a portion of the refrigerant distributor extending inside the header; and a flow valve, the flow valve is positioned on the portion of the refrigerant distributor extending inside the header;

wherein the portion of the refrigerant distributor extending inside the header has at least one orifice;

the flow valve has a closed state and an open state, the closed state of the flow valve is configured to generally prevent a refrigerant flow through the first flow valve, and the open state of the flow valve is configured to generally allow refrigerant to flow through the first flow valve.

Aspect 14. The heat exchanger of aspect 13, wherein the refrigerant distributor has a first end that is configured to receive refrigerant, and the flow valve is positioned closer to the first end of the refrigerant distributor than the at least one orifice.

Aspect 15. The heat exchanger of aspects 13-14, wherein the refrigerant distributor has a first end that is configured to receive refrigerant, and the flow valve is positioned further away from the first end of the refrigerant distributor than the at least one orifices.

Aspect 16. The heat exchanger of aspects 14-15, further comprising a second flow valve, wherein the second flow valve is positioned closer to the first end of the refrigerant distributor than the at least one orifice.

Aspect 17. The heat exchanger of aspects 15-16, further comprising a second flow valve, wherein the second flow valve is positioned closer to the first end of the refrigerant distributor than the at least one orifices.

Aspect 18. The heat exchanger of aspects 13-17, wherein the heat exchanger is a micro-channel heat exchanger.

Aspect 19. A heat exchanger, comprising:

a header; and a refrigerant distributor, a portion of the refrigerant distributor extending inside the header;

wherein the refrigerant distributor has a longitudinal end positioned inside the header, the longitudinal end has an orifice.

Aspect 20. The heat exchanger of aspect 19, further comprising:

a refrigerant outflow pipe connected to the header, wherein the refrigerant outflow pipe is configured to direct fluid out of the heat exchanger.

Aspect 21. The heat exchanger of aspect 20, wherein the refrigerant outflow pipe is equipped with a check valve; wherein the check valve is configured to have an open state and a closed state, the open state is configured to allow refrigerant to flow from the header to the refrigerant outflow pipe, and the closed state is configured to prevent refrigerant from flowing from the header to the refrigerant outflow pipe.

Aspect 22. A heat exchanger, comprising:

a header;

a plurality of tubes;

a divider positioned inside the header, the divider dividing the header into a first compartment and a second compartment;

wherein the divider has one or more orifices, the orifices is configured to allow refrigerant to flow from the second compartment to the first compartment; and the first compartment is configured to distribute refrigerant into the plurality of tubes.

Aspect 23. The heat exchanger of aspect 22, wherein the first compartment is equipped with a check valve, the check valve has an open state and a closed state, and when the check valve is in the open state, refrigerant is allowed to flow out of the first compartment, and when the check valve is in the closed state, refrigerant is prevented from flowing out of the first compartment.

Aspect 24. The heat exchanger of aspects 22-23, wherein the divider is positioned relatively closer to a bottom portion than to a top portion of the header.

Aspect 25. The heat exchanger of aspects 24, wherein the divider has raised edges that conform to a cross-section profile of the header.

With regard to the foregoing description, it is to be understood that changes may be made in detail, especially in matters of the construction materials employed and the shape, size and arrangement of the parts without departing from the scope of the present invention. It is intended that the specification and depicted embodiment to be considered exemplary only, with a true scope and spirit of the invention being indicated by the broad meaning of the claims.

What claimed is:

1. A refrigerant distributor of a heat exchanger comprising:

a tube including a plurality of orifices;

a flow valve having an open state and a closed state and positioned on a sidewall of the tube; and a header housing the tube and the flow valve, the header being connected to heat exchange tubes of the heat exchanger, wherein the flow valve is configured to be in the closed state preventing refrigerant flow through the flow valve into the tube in a cooling mode, and to be in the open state allowing refrigerant to flow through the flow valve into the tube in a heating mode, the flow valve is configured to prevent refrigerant between the sidewall of the tube and the sidewall of the header from flowing through the flow valve into the tube in the closed state in the cooling mode, and to allow refrigerant between the sidewall of the tube and the sidewall of the header to flow through the flow valve into the tube in the open state in the heating mode, and the flow valve is configured to reduce pressure drops in the refrigerant flow through the header, a first end of the tube is configured to receive refrigerant from outside of the header into the tube, and the flow valve is positioned either closer to the first end of the tube than any of the plurality of orifices, or further away from the first end of the tube than any of the plurality of orifices.

2. The refrigerant distributor of claim 1, further comprising:

a second flow valve;

wherein the flow valve and the second flow valve are positioned closer to the first end than any of the plurality orifices; and the flow valve and the second flow valve are staggered at an angle around a circumferential profile of the sidewall of the tube of the refrigerant distributor.

3. The refrigerant distributor of claim 1, further comprising:

a second flow valve positioned closer to the first end of the tube than any of the plurality of orifices, wherein the flow valve is positioned further away from the first end of the tube than any of the plurality of orifices.

4. The refrigerant distributor of claim 1, wherein the tube of the refrigerant distributor has a second end, the flow valve is positioned at the second end of the tube further away from the first end of the tube than any of the plurality of orifices.

5. The refrigerant distributor of claim 1, wherein the tube of the refrigerant distributor has a second end, and the refrigerant distributor further comprises a second flow valve positioned at the second end of the tube, the second flow valve being positioned further away from the first end of the tube than any of the plurality of orifices.

6. A refrigerant distributor of a heat exchanger comprising:

a tube including a plurality of orifices, the tube having a first end and second end, the first end of the tube is configured to receive refrigerant in the cooling mode;

a flow valve disposed at the second end of the tube; and a header housing the tube and the flow valve, the header being connected to heat exchange tubes of the heat exchanger, the flow valve being positioned further away from the first end of the tube than any of the plurality of orifices, the flow valve is configured to be in the closed state preventing refrigerant flow from outside the header into the tube to flow through the flow valve in a cooling mode, and to be in the open state allowing refrigerant flow from inside the header to flow through the flow valve into the tube in a heating mode, and the flow valve is configured to prevent refrigerant between the sidewall of the tube and the sidewall of the header from flowing through the flow valve into the tube in the closed state in the cooling mode, and to allow refrigerant between the sidewall of the tube and the sidewall of the header to flow through the flow valve into the tube in the open state in the heating mode.

* * * * *